United States Patent [19]

Morris et al.

[11] Patent Number: 4,945,288

[45] Date of Patent: Jul. 31, 1990

[54] DOUBLE JACKET LAMP

[75] Inventors: Merle E. Morris, Lexington; Michael L. Martin, Jeffersonville; Louis D. Neff, Mt. Sterling; George B. Kendrick, Lexington, all of Ky.

[73] Assignee: GTE Products Corporation, Danvers, Mass.

[21] Appl. No.: 287,932

[22] Filed: Dec. 21, 1988

[51] Int. Cl.[5] ..... H01J 61/34

[52] U.S. Cl. ..... 313/25; 313/623; 313/634; 313/26

[58] Field of Search ..... 313/25, 26, 623, 634, 313/635, 637, 643

[56] References Cited

U.S. PATENT DOCUMENTS 3,194,625 7/1965 Danko ..... 313/26 X 4,490,642 12/1984 Dobrusskin et al. ..... 313/25

FOREIGN PATENT DOCUMENTS 74-29918 4/1976 France .

*Primary Examiner*—Kenneth Wieder

*Attorney, Agent, or Firm*—William E. Meyer

[57] ABSTRACT

A double jacket arc lamp is disclosed. A double jacket arc lamp may be formed with an electric lamp capsule having an inner light transmissive envelope with electrical lead extending from the inner envelope through a first seal, and a second light transmissive envelope sealed to the inner envelope at a second seal to substantially surround the electric lamp capsule and form an enclosed volume between a portion of the exterior of the inner envelope and the interior of the outer envelope, and leaving the leads unenclosed by the outer envelope. The lamp leads then pass through only one seal, and have no portions exposed in the intermediate insulating volume. The inner capsule is then aligned once, while still being for the most part protected by a double envelope.

26 Claims, 8 Drawing Sheets

DOUBLE JACKET LAMP

CROSS REFERENCE

Basic aspects of this invention are disclosed in a simultaneously filed, copending application, U.S. Ser. No. 287,931, Oxygen Protected Electric Lamp, by David A. Cox and Stephen P. Senft.

1. Technical Field

The invention relates to electric lamps and particularly to doubled envelope electric lamps. More particularly the invention is concerned with double jacketed arc discharge lamps wherein the inner jacket is sealed to the outer jacket.

2. Background Art

Arc discharge lamps generate light by passing an electric current through an ionized gas. The discharge gas, including various dopants selected for spectral features, is thereby heated to yield light. The surrounding envelope is necessarily heated at the same time which helps vaporize any solid or liquid dopants. The dopants evaporate to a degree generally determined by the coldest temperature of the inside envelope surface, which therefore affects the lamp spectrum. Temperature control in the envelope is then important to proper lamp function. One method of controlling temperature is to jacket the lamp envelope with an outer envelope. The outer envelope allows the inner envelope to be heated uniformly to a higher temperature. The outer jacket reduces thermal gradients in the inner envelope, conserves the arc tube heat, and shields the inner envelope from exterior temperature changes. The outer jacket may also be used to filter a certain portion of the energy spectrum, for example, ultraviolet radiation, lower the temperature of the outer exposed surface, dampen any corona effect at high frequencies, or simply to contain any lamp failures that may occur in the capsule.

The known method of jacketing the inner envelope is to form the inner lamp as an ordinary lamp with a first seal and the various appended leads. The inner lamp is then inserted in an outer envelope and held in place with internal support structures. An intermediate volume is then formed between the inner and outer envelops which may be evacuated, or filled with an inert gas. The support structures are typically composed of wire rods, and metal straps; but may include glass beads, ceramic rods, or other nonconductive insulative elements. The metal leads from the inner lamp are then lead out through the intermediate volume to a second seal made with the outer envelope.

The existing wire structures are expensive to make. The internal support structures are expensive, not so much for the cost of materials, but for the cost of assembling, aligning, testing, and similar labor costs. Also, the outer envelope must be large enough to enclose the internal positioning structures, in addition to providing an adequate insulating volume. The large exterior envelope is an additional material cost. The large exterior envelope further requires a large supporting base, and therefore a large socket, and therefore a large lamp housing and so on. It is a general design advantage to make a lamp small and thereby reduce all the subsequent related lamp costs. There is then a need to provide a double jacketed lamp with a small size, and a similar need for a double jacketed lamp without expensive metal positioning equipment.

The existing wire support structures may also be difficult to align. The seals made in press sealing an envelope are commonly made by pressing the surrounding molten envelope material against molybdenum foils. The foils can expand and contract with the envelope during normal thermal cycling of the lamp. Unfortunately, the foils have little rigidity and may be twisted, or flexed during assembly. The result can be a misalignment of the inner envelope with respect to the outer envelope. Anticipating such misalignment accounts for some of the expensive internal positioning hardware seen in double jacketed lamps. There is then a need to provide a sealing mechanism for double jacketed lamps that reduces the possibility of misalignment.

The existing structure may be subject to internal electrical faults. The support structure between the inner envelope and the outer envelope is usually metal, and therefore conductive. In arc discharge lamps, high voltages are used to strike the arc, and the nearby metal support structures are likely sources for voltage leakage. Also, the inner, or outer envelope may leak gas, allowing the changing gas composition to alter the electrically insulating aspects of the intermediate volume. A secondary glow may result between the leads passing through the intermediate volume, altering the quality of the lamp, and possibly leading to early lamp failure. Getters, insulating separators and similar protective structures may then be required in the intermediate volume, but increasing the lamp cost. There is then a need for a double jacketed lamp that reduces the possibility of electrical fault in the intermediate volume.

Arc discharge lamps often use high voltage, high frequency pulses to start or restart the arc. Operating at high frequencies and high voltages offers the possibility of a glow discharge or corona around both metal and glass parts in the lamp. The corona drains the useful energy supplied to the lamp making it more difficult to ignite, and may cause other problems in lamp operation. The outer lamp leads may be potted with high dielectric cements to prevent the glow discharge or corona affect, but around the inner lamp capsule potting is not possible. There is then a need to prevent, suppress or make the corona glow harmless in the intermediate volume.

In its clear state, glass is an amorphous or non-crystalline material. At elevated temperatures, such as the operating temperatures of electric lamps, glass becomes more chemically active. With increasing temperature, glass tends to devitrify, that is, become crystalline, due either to the loss of oxygen or the introduction of contaminants at the surface. The devitrifying surface reactions may start as a single crystal structure which in time grows to greater depths in the glass. Crystallization causes the glass to loose transparency and become more brittle. Lamps in general, but arc lamps in particular operate more efficiently at higher temperatures. To avoid devitrification, lamps are therefore usually operated at a temperature less than that causing devitrification. The lower temperature is then at the expense of lamp efficiency. There is then a need to prevent devitrification while allowing lamps, and particularly arc discharge lamps, to be operated at higher, more efficient temperatures.

Often it is desirable to coat certain portions of a lamp with reflective, heat absorbing, filtering or similar coatings. The coatings are generally oxides of active metals such as zirconium, tantalum, or magnesium but the use of other coatings is known. At high temperatures, the metal oxide coatings may break down giving up oxygen, which is then free to combine elsewhere, or otherwise interfere with the lamp chemistry or composition. The coating may also be attacked by contaminants, or in breaking down, react with the envelope. The coating, in breaking down, also is less functional and may fail to be adequate in extended service. There is then a need to protect lamp coatings, and particularly metal oxide coatings, without damaging the lamp chemistry, or composition.

Metal exposed to hot oxygen gas normally deteriorates. In particular, the oxygen in the intermediate volume with the various included metal parts as shown in the prior art is considered a problem to be avoided. In particular, the oxygen may track along the sealed leads and oxidize the seal components, such as foils. As the seal components oxidize, the seal may open up because of a thermal mismatch in the new compounds, and because the conductivity of the leads may be reduced, resulting in a hotter running lead. The hotter lead may cause further deterioration of the seal. Corroded seals are a problem to be avoided, so the use of only inert fill gas is though to be standard practice.

Hydrogen may also be a problem element an inner lamp capsule, and particularly in an arc discharge capsule. Hydrogen in an arc discharge lamp has undesirable affects on both lamp starting and lamp life. Hydrogen is a small, and chemically active element. Hydrogen is small enough to easily migrate through glass, and at elevated temperatures, such as those found in electric lamps, hydrogen migration may be acute. There is then a need to prevent hydrogen activity in the inner lamp capsule, and to prevent migration of hydrogen to the inner lamp capsule.

U.S. Pat. No. 4,754,195 to Rasch et al for High Pressure Discharge Lamp, and Method of its Manufacture shows an inner high pressure discharge lamp with a press seal positioned in an outer envelope also sealed with a press seal. The outer press seal is made with the lamp leads, so the inner lamp floats on exposed lamp leads completely internal to the outer envelope. U.S. Pat. No. 4,717,852 to Dobrusskin et al for Low-Power, High-Pressure Discharge Lamp shows an inner arc discharge lamp enclosed in an outer envelope where the outer envelope seals on the lamp leads leaving the inner envelope free floating.

DISCLOSURE OF THE INVENTION

A double jacket arc lamp may be formed with an electric lamp capsule having an inner light transmissive envelope with electrical leads extending from the inner envelope through a first seal, and a second light transmissive envelope sealed to the inner envelope at a second seal to substantially surround the electric lamp capsule and form an enclosed volume between a portion of the outside surface of the inner envelope and the inside surface of the outer envelope, and with the leads extending to the exterior of the outer envelope.

BEST MODE FOR CARRYING OUT THE INVENTION

Figure 1:
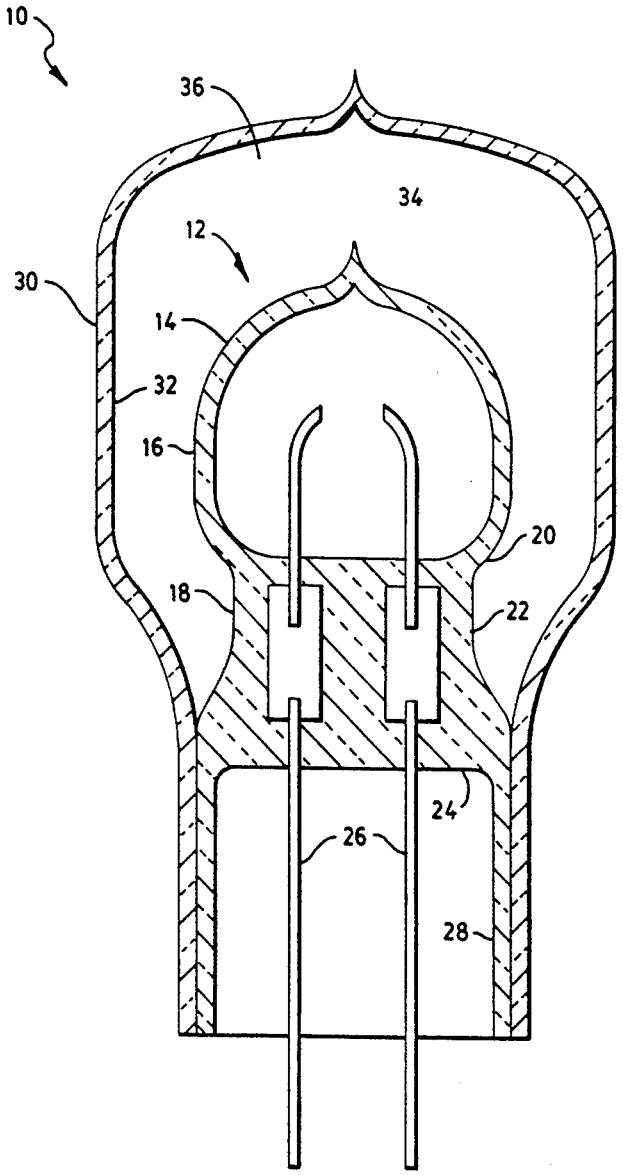
FIG. 1 shows a preferred embodiment of an axial cross section of a preferred embodiment of a double jacket arc lamp capsule.

FIG. 1 shows a preferred embodiment of an axial cross section of a preferred embodiment of a double jacket lamp. The double jacket lamp 10 includes an inner lamp capsule 12 having a means of generating light from electric energy. The preferred inner lamp capsule 12 is an arc discharge lamp capsule, but the lamp structure and gas fill discussed here may be equivalently extended to filamentary lamps with ordinary engineering. The lamp capsule 12 includes an inner envelope 14 with an outer surface 16, and a seal. The seal may be any conventional seal for the type of inner lamp capsule 12 used. Arc discharge and tungsten halogen lamp capsules are typically press sealed, and the preferred seal is a press seal 18. Adjacent the point of the inner lamp capsule 12, the press seal 18 includes a capsule side portion 20. The press seal 18 next includes a central portion 22 where the envelope material is pressed to form the seal. The press seal 18 then includes an outer portion 24 where two leads 26 emerge to the exterior.

In the preferred embodiment, the inner lamp capsule 12 is formed by closing one end of a tube, and press sealing an opposite end to capture the inner electrode leads, foils, and outer leads 26. The preferred press seal 18 is made at a point intermediate the tube ends so the enclosed inner lamp capsule 12 is on one side of the press seal 18, and on the opposite side of the press seal 18 is a radial extension of the inner capsule envelope material, offset from the outer leads 26. The radial extension then forms a skirt 28. The skirt 28 preferably has sufficient diameter and length to conveniently seal with. The skirt 28 may be conveniently formed as an unpressed, residual portion of the original tubing, and having an outer diameter approximately equal to the inner envelope diameter. The skirt 28 may also be formed with a tool, or added as a separate piece.

Substantially surrounding the inner envelope 14, but allowing the lamp leads 26 to pass to the exterior for electrical connection is an outer envelope 30 with an inside surface 32. The material used in forming the inner envelope 14 may be repeated in the outer envelope 30, for example both envelopes may be made from quartz. Using a different outer envelope material allows the lamp spectrum to be sculpted for chosen purposes. In particular, a quartz inner envelope 14 transmits the ultraviolet light typical of a mercury doped arc lamp. Portions of the ultraviolet light may be cut off at different wavelengths, according to the formulation of the outer envelope material. For example, an ozone generating lamp, or an ozone free germicidal lamp may be made according to different glass formulations. For example, an ozone free quartz may be made by doping quartz with titanium or vanadium. Other dopants and formulations similarly alter the spectral transmission. The inside surface 32 may be clear, or may be etched, coated or roughened to provide a diffused source image.

The inside surface 32 may also be dichroicly coated to alter the spectrum for safety, color temperature, heat control, color rendering, or similar purposes. The typical surface coatings include layers of metal oxides but many others are known. The inside surface 32 may be phosphor coated or similarly treated, since no chemical interaction occurs between the internal chemistry of the inner lamp capsule 12, and the inside surface 32. The inside surface 32 is similarly protected from the exterior.

The geometric extent of the inner envelope 14 is for the most part smaller than the enclosing outer envelope 30. It is also possible for the inner envelope 14 to contact portions of the outer envelope 26, and in particular, such contacts may be useful in initial positioning the inner lamp capsule 12 with respect to the outer envelope 30. Formed between the inner envelope 14 and the outer envelope 30 is then an insulating intermediate volume 34. The inner lamp capsule 12 is sealed in the region of the press seal 18 to the outer envelope 30. The seal with the inner lamp capsule 12 may be made on the capsule side portion 20, or the central portion 22. While both the capsule side portion 20, and central portion 22 are possible seal point, sealing to these areas is felt to likely stress, or distort the inner lamp capsule, and therefore require more care. The preferred sealing point is on the outer portion 24, and in particular to an extended skirt 28.

With the inner lamp capsule 12 sealed to the outer envelope 30, a large portion of the inner lamp capsule 12, is then enclosed and insulated by the intermediate volume 34. The intermediate volume 34 may be a vacuum, or may be filled with an inert fill gas 36, such as argon, or nitrogen. Since the intermediate volume 34 is segregated from the internal light generating mechanisms of the inner lamp capsule 12, and the exterior, there is no reason why noninert gases may not also be used. The intermediate volume may then be filled with a noninert fill gas such as oxygen mixed with an inert gas, or even pure oxygen. Other active gases or combinations thereof may be formulated for inclusion in the intermediate volume.

Figure 2:
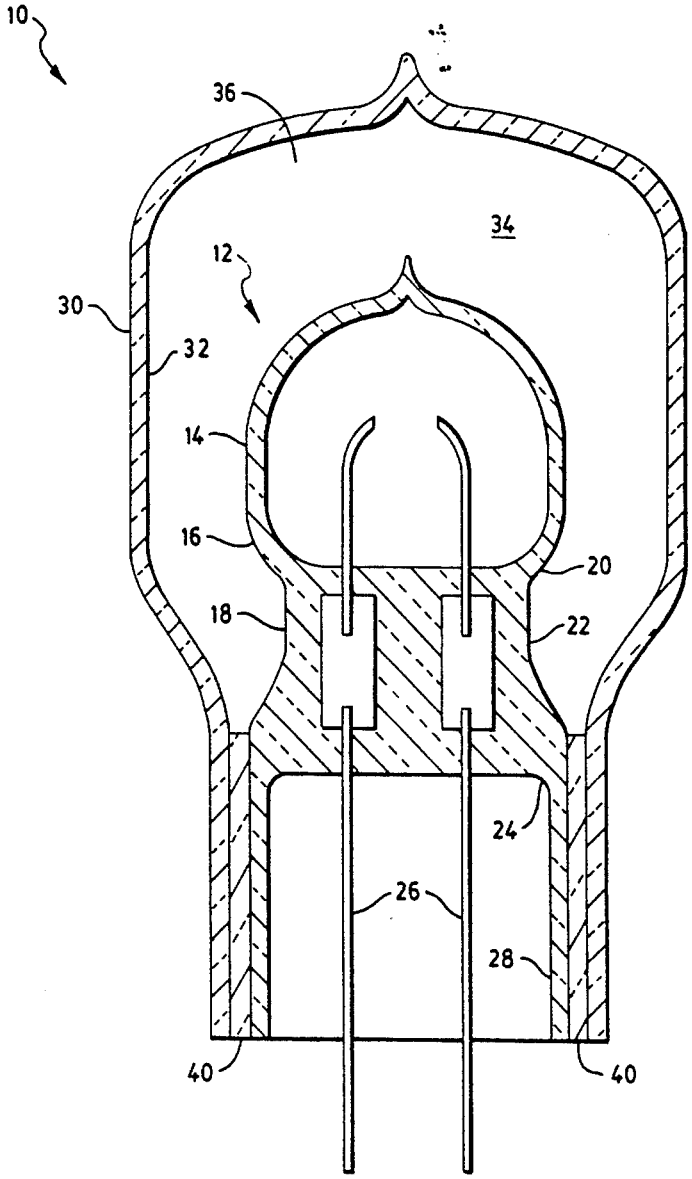
FIG. 2 shows an axial cross section of an alternative embodiment of a double jacketed arc lamp with a spacer ring in the seal area.

The inner envelope 14 should be thermally matched to the outer envelope 30 to avoid cracking or separation during normal thermal cycling of the lamp. The preferred method is to thermally match the materials of the inner envelope 14 or at least the portion coupling with the outer envelope 30 such as skirt 28. The simplest method is to use the same materials for both envelopes. Quartz is a relatively expensive material to make lamp envelops from, but quartz has good high temperature qualities. Glasses on the other hand are less expensive, provide adequate protection from the exterior, and can be formulated for spectral transmission. There is then an advantage to using quartz with a thermal expansion of about $5.5\times10^{-7}$ cm/cm degree C. as the inner envelope 14, and a glass, such as a borosilicate with a thermal expansion of about 30 to $50\times10^{-7}$ cm/cm degree C. as an outer envelope 30. An alternative method of thermal matching is to include a spacer ring 40 between the inner envelope 14 and outer envelope 30 in the zone where the seal is made between the two envelopes such as between the skirt 28 and envelope 30. The spacer ring 40 may be a tubular section sized to fit between the coupling envelope portions and made of a material with an intermediate coefficient of thermal expansion thereby forming a graded seal. The spacer ring 40 seals on one side to the inner envelope 14, and seals on an opposite side to the outer envelope 30. FIG. 2 shows an axial cross section of an alternative embodiment of a double jacketed arc lamp with a spacer ring in the seal area. Other graded seal methods, such as coating intermediate materials, may be used in the inner envelope to outer envelope seal.

In one embodiment, the double jacket arc lamp may be manufactured by first forming an arc lamp capsule with an extended portion radiating from the seal. The inner lamp capsule 12, and outer envelope 30 may then be merged to form a hermetic seal at a necked down portion of the outer envelope 30. The inner lamp capsule 12 may then be said to cork the outer envelope 30. With the inner lamp capsule 12 sealed to the outer envelope 30 around the seal area, the intermediate volume 34 is then evacuated, or filled with a fill gas 36. The opposite, second end of the outer envelope 30, the end away from the lamp leads 26 is then sealed. The second outer envelope seal may be a press seal, but the preferred method is to tip off the outer envelope 30. The inner envelope 14 is then substantially thermally insulated from the exterior. The inside surface 32 of the outer envelope may be safely treated with coatings to alter the light produced without interference from the inner envelope chemistry. No metal, or other voltage carrying elements are required in the intermediate volume 34, and no metal or conductive elements are required to be positioned near the lamp leads 26. The inner lamp envelope 14 is aligned without internal metal hardware.

Figure 3:
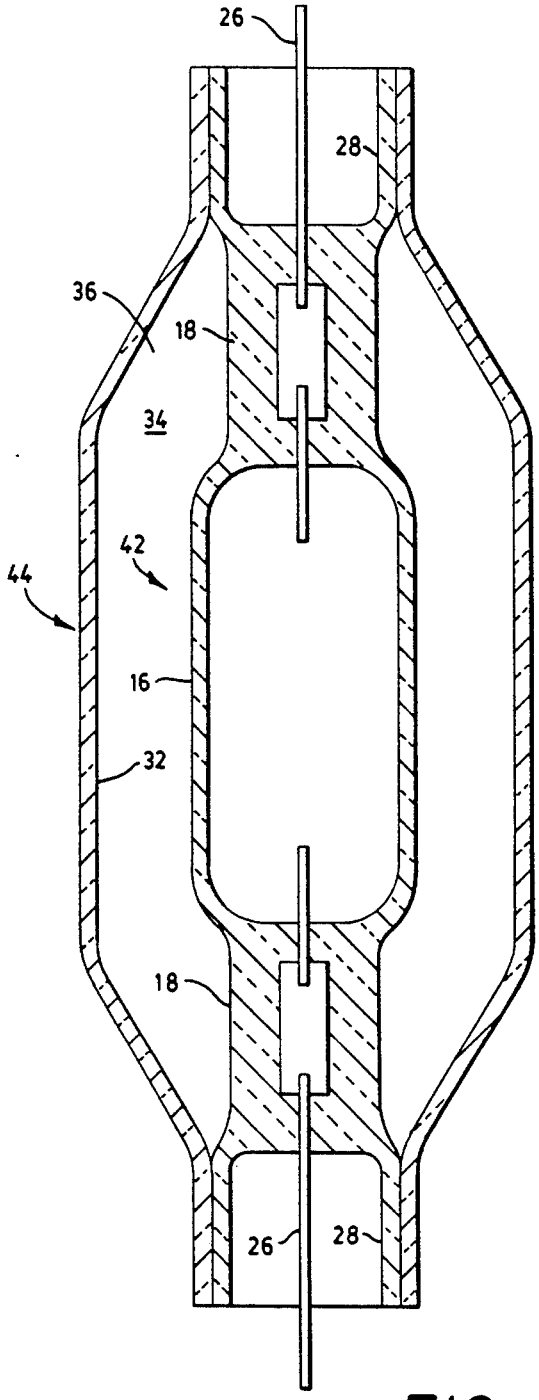
FIG. 3 shows a preferred embodiment an axial cross section of an of a double jacketed, double ended arc lamp.

In an alternative embodiment, the inner lamp capsule may be made as a double ended inner lamp capsule 42, with lamp leads 26 emerging at opposite ends of the inner lamp capsule. Two skirts 28 may be formed on opposite ends, with two press seals 18 intermediately positioned. An enclosing outer double ended envelope may be slipped over the inner lamp capsule 22 and coupled at each end to the two skirts 28. FIG. 3 shows a preferred embodiment of an axial cross section of an of a double jacketed, double ended arc lamp.

Figure 8:
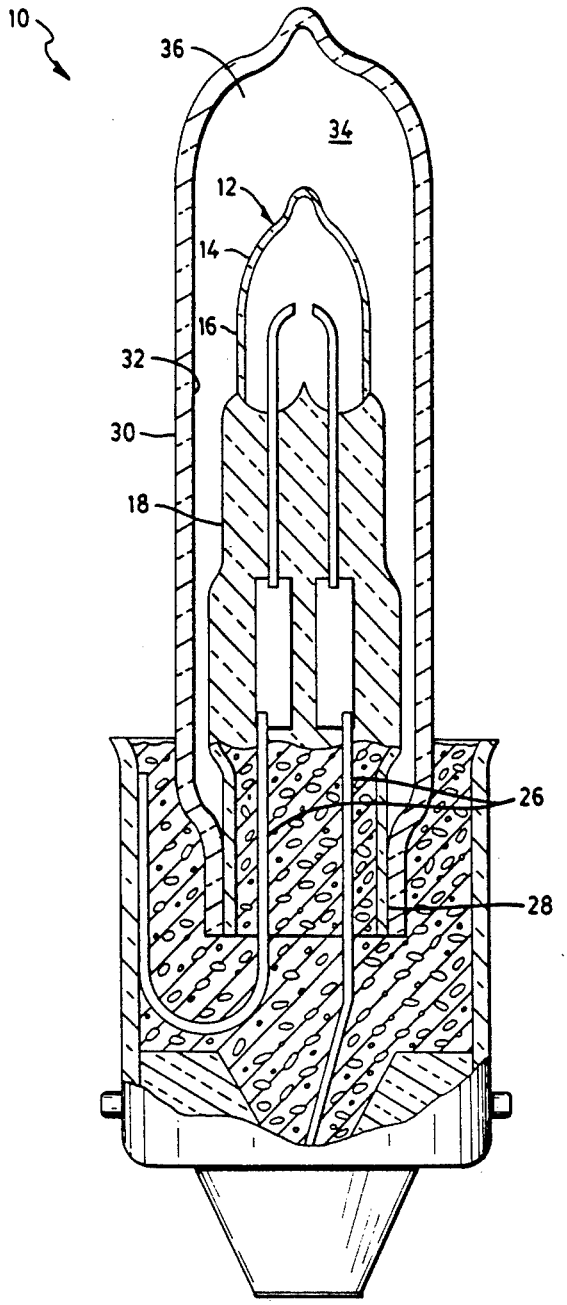
FIG. 8 shows a preferred embodiment of an axial cross section of a preferred embodiment of a double jacket arc lamp.

To make the overall lamp structure small, its is felt to be preferable to neck the outer envelope 30, 40 down to the inner lamp capsule 12, 42. The decreasing diameter of the necked portion may then be captured in a cemented type base (FIG. 8). Alternatively, a screw type base may be preferred. It is then convenient that the lamp base not neck down but maintain a fairly constant radial extension to securely meet with a screw type base (FIG. 4).

Figure 4A:
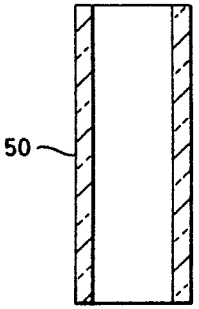
FIG. 4A–FIG. 4F show a series of cross sectional views of the stages of manufacture of an alternative single ended double jacketed lamp.
Figure 4B:
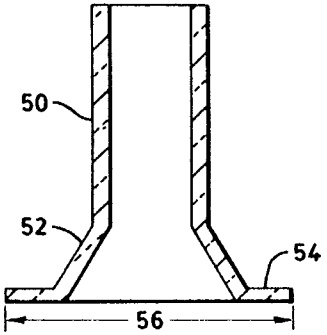

FIGS. 4A–F show a series of cross sectional views of the stages of manufacture of an alternative single ended double jacketed lamp, for example, one intended for use in a standard screw type base. The outer envelope need not be necked down to be joined to the inner lamp capsule. The skirt portion may in one alternative be flared out to meet the outer envelope. FIG. 4A shows a tube 50 of a meltable, light transmissive material of the type used to make filamentary, or arc discharge lamps. The end of the tube 50 may be heated by, for example flames, to soften the end. A tool may be inserted in the tube cavity, adjacent the softened tube end, and used to flare the softened tube ends outwards. The flare may be made in sections, approximately coaxial with the tube 50. For example, a first section may be a funnel shaped portion 52, leading with further curvature to a disk portion 54. The disk portion 54 need not have a large radial extension 56, but may be limited to the radial depth of the intermediate volume 34 to be created. FIG. 4B shows a tube with a flared end.

Figure 4C:
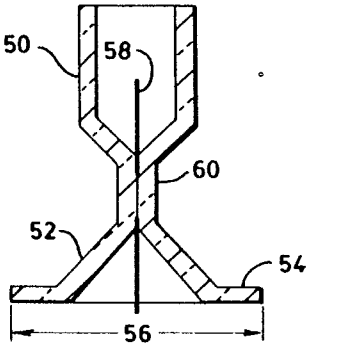

The flared end tube may then receive a light generating means 58, such as a filament, or arc discharge electrode structure, positioned in the inner tube cavity, and the outer leads projecting from the flared tube end. The flared tube may then be press sealed 60 by methods known in the art to capture the filament or electrode structure. The press seal 60 is preferrably made axially adjacent the flared end of the tube. Press sealing the flared end may thin portions of the envelope material to an unacceptable degree, while press sealing offset from the flared end is thought to needlessly lengthen the lamp structure. FIG. 4C shows a flared tube, equipped with an electrode structure 58, and press sealed 60 adjacent the flared end of the tube.

Figure 4D:
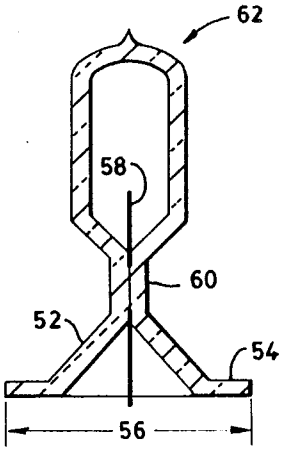

The inner lamp capsule may then be filled with a gas fill and closed by known methods to complete the inner lamp capsule 62 structure. FIG. 4D shows a completed inner lamp capsule 62 with a flared base extending to a disk portion 54. The disk portion 54 is functionally equivalent to the skirt 28 for sealing purposes.

Figure 4E:
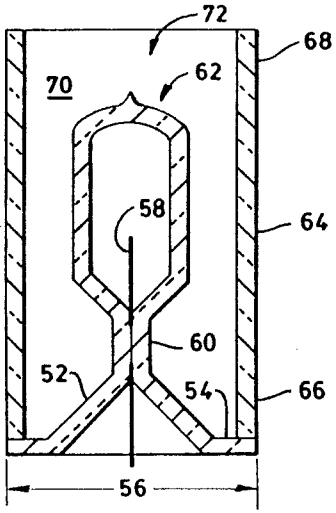

The next step of assembly is to enclose the inner lamp capsule 62 with an outer envelope 64. The inner lamp capsule 62 may be enclosed by a straight tubular section with a first end 66 and second end 68, so the extended disk portion 54 and first end 66 are butted together. The junction of the extended disk portion 54, and the first end 66 may be heated and allowed to fuse, thereby forming a hermetic seal. FIG. 4E shows an inner lamp capsule 62 with a flared base mated to an enclosing straight tube outer envelope 64.

Figure 4F:
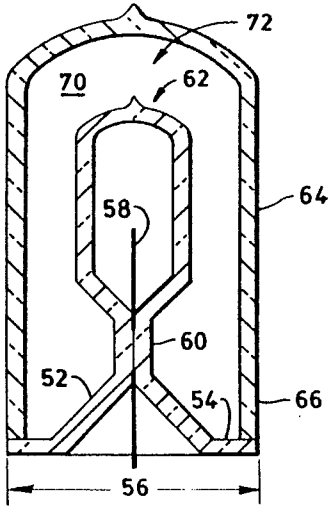

The inner lamp capsule 62 and the enclosing, but offset outer envelope 64 form an intermediate volume 70 which may be filled with a selected fill gas 72. The second end 68 may then be closed by know methods, such as press sealing, or tipping off. FIG. 4F shows an inner lamp capsule 62 with a flared base mated to an enclosing straight tube outer envelope 64 with the second end 68 of the outer envelope tipped off.

Figure 5D:
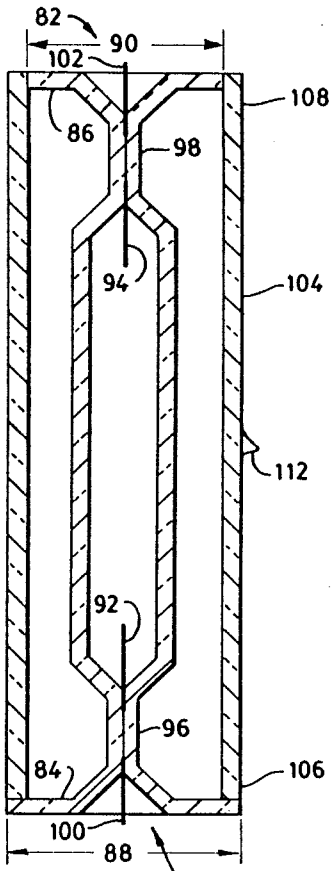
FIG. 5A–FIG. 5D show a series of cross sectional views of the stages of manufacture of an alternative embodiment of a double ended double jacketed lamp.
Figure 5C:
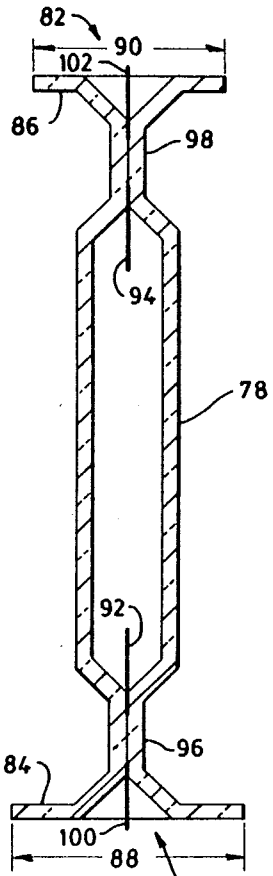
Figure 5B:
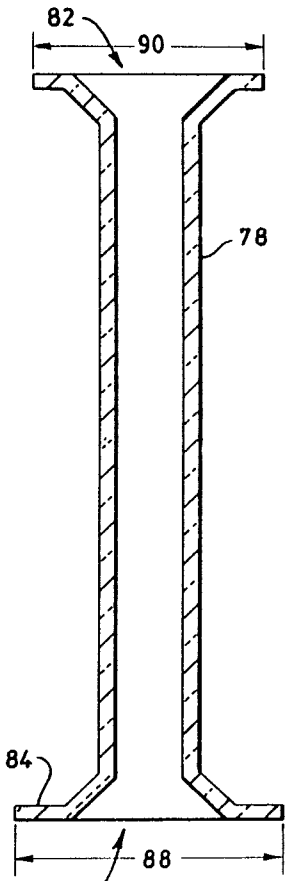
Figure 5A:
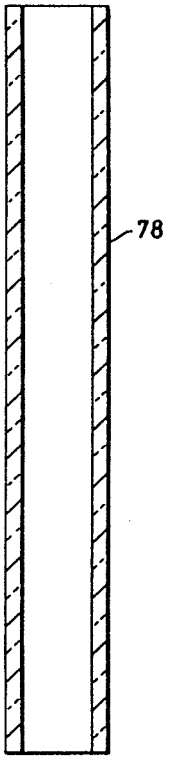

A similar method of construction may be used in forming a double ended lamp. FIGS. 5A–D show a series of cross sectional views of the stages of manufacture of an alternative double ended double jacketed lamp. A tube 78 may be flared at both ends 80, 82, FIG. 5B, forming flared skirt like portions, for example disk portions 84, 86 extending radially from the ends of the tube. The first disk portion 84 may have a diameter 88 some what larger than the second disk 86 portion's diameter 90. The first end 80 and second end 82 may receive electrode structures 92, 94 and be press sealed 96, 98 adjacent the flared portions to capture electrodes 92, 94 in the press seals 96, 98, leaving outer leads 100, 102 axially projecting from the flared tube ends. FIG. 5G shows a double ended inner lamp capsule formed with flared ends having radially extending disk portions. Electrodes 92, 94 are captured in the press seals 96, 98.

A straight tubular section 104 with a first end 106 and second end 108 may be chosen with an inside diameter less than the radial extension 88 of the first disk portion 84, and slightly greater than the radial extension 90 of the second disk portion 86. The straight tubular section 104 with an exhaust tube may be slipped over the inner lamp capsule, so the first disk section 84 and first tube end 106 are adjacent, and the second disk section 86 is adjacent the inside surface of the tube 104. The first disk section 84 and first tube end 106 may be fused in a flame to form a hermetic seal, and the second disk section 86 and tubular section 104 may be similarly fuse to seal off the enclosed intermediate volume 110. An inner lip may be formed on the straight tube to assist in making the second seal. The intermediate volume 110 may then be evacuated, or filled through the exhaust tube and then sealed by closing the tube 112. FIG. 5D shows a double ended, double jacketed lamp with a straight tubular outer envelope.

Figure 6D:
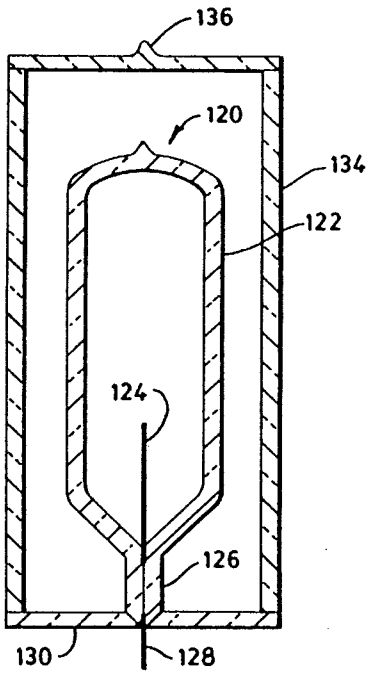
FIG. 6A–FIG. 6D show a series of cross sectional views of the stages of manufacture of an alternative embodiment of a single ended double jacketed lamp.
Figure 6C:
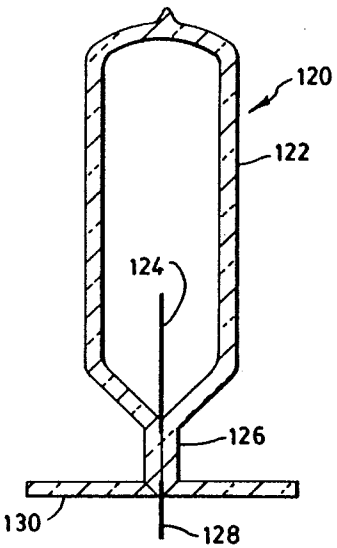
Figure 6B:
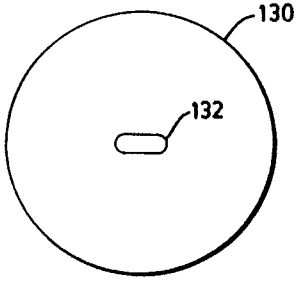
Figure 6A:
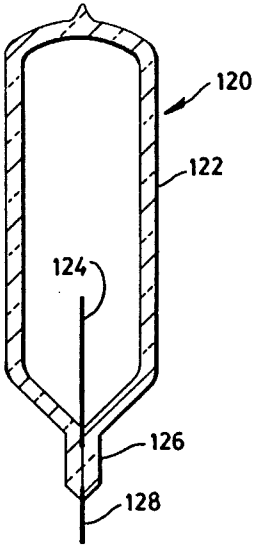

FIGS. 6A–D show a series of cross sectional views of the stages of manufacture of an alternative single ended double jacketed lamp. The radial skirt portion need not be initially formed as a portion of the press seal, but alternatively may be added subsequently in a separate step. The separate addition of the radial skirt portion is less preferred, but is considered functional. FIG. 6A shows a standard press sealed lamp capsule to be adapted as an inner lamp capsule 120. The inner lamp capsule 120 includes an envelope 122, with a filament or electrode structure 124 captured in a press seal 126, with outer lead(s) 128 extending for electrical connection. FIG. 6B shows a disk 130 of envelope material with an aperture 132 adapted to receive and mate with a portion of the inner lamp capsule 120, for example the axial end of the press seal 126. The inner lamp capsule 120 is mated with the disk 130 so the outer leads 128 extend through the disk aperture 132. The inner lamp capsule 120 and disk 130 may then be fused to form a seal. FIG. 6C shows an inner lamp capsule 120 mated to and sealed with a disk 130 thereby forming a press seal with a radial skirt portion. The inner lamp capsule 120 may then be enclosed with an outer envelope 134. FIG. 6D shows the inner lamp capsule with the attached disk portion coupled with a straight tubular outer jacket seal with a plate end with a tipped off tubulation 136.

Figure 7B:
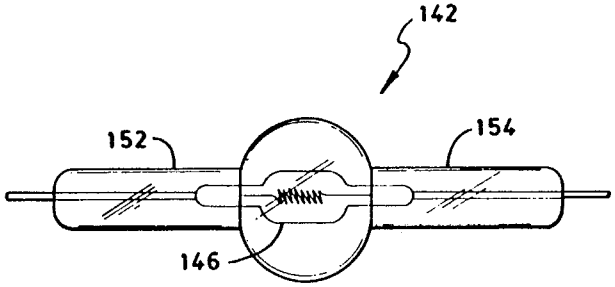
FIG. 7A–FIG. 7B show alternative embodiments of a double jacketed single ended double press sealed lamp, and a double jacketed, double ended, double press sealed lamp.
Figure 7A:
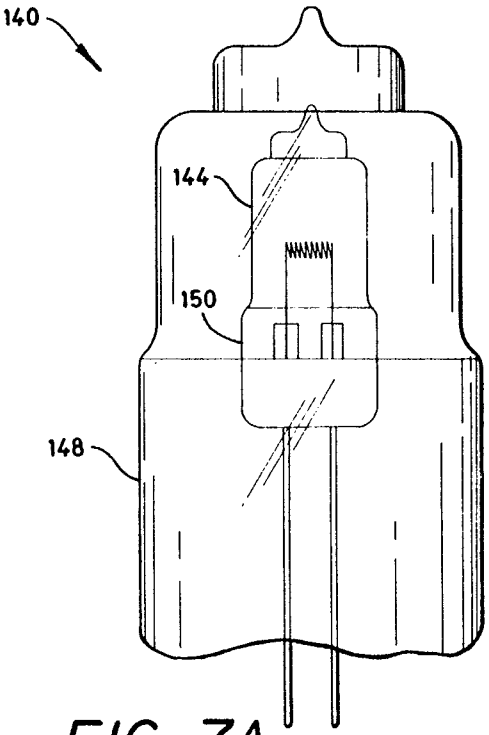

FIGS. 7A, B show a double jacketed single ended double press sealed lamp 140, and a double jacketed, double ended, double press seal lamp 142. The lamps portrayed in FIG. 7A, and 7B, use the known press seal designs for the inner lamp capsules 144, 146. The outer envelope is then added to substantially surround the inner lamp capsule by forming a single press seal 148, in the case of FIG. 7A, to couple with the single press seal 150 of the inner lamp capsule 144. Similarly, in the case in FIG. 7B, two press seals are used to couple the outer envelope to the two press seals 152, 154 of the double ended inner lamp capsule. The two designs are theoretically possible; however, to thermally accommodate the union, the inner lamp capsules need to be heated, which is thought to invite a break down of the original seals, over pressurize the inner lamp capsules 144, 146, lead to misalignment, or have other undesirable results. The designs shown in FIG. 7A and FIG. 7B are then thought to be functional, but are felt to require more care in completing, and are therefore less preferred.

In the present double jacketed configuration, no metal support or electrical conductors are required in the intermediate volume between the inner lamp capsule and outer envelope. The inner lamp capsule leads extend directly to the outside of the inner lamp capsule and outer envelope assembly without passing through the intermediate volume. As a result, the intermediate volume may contain a fill gas mixture including noninert gases, and in particular oxygen containing mixtures or even pure oxygen. The addition of chemically active gases, and in particular an oxygen atmosphere, to the intermediate volume of outer envelope of electric lamps may have a number of advantages, such as glass and coating stabilization, corona suppression, and hydrogen gettering and similar functions depending on the particular lamp.

A preferred fill gas for the intermediate volume includes oxygen. Pure oxygen is preferred for lamp performance. Oxygen fill helps stabilize glass at high temperature to slow or prevent devitrification. If the glass surface gives up oxygen, oxygen from the fill gas is available to replace the lost oxygen. The more active oxygen may also preferential bond with silicon to the exclusion of contaminants. The more active oxygen may also bond directly with the contaminant to prevent the contaminant from combining with the glass. Damage to the glass surface is then either delayed, prevented or even healed by oxygen in the fill gas. As a result, the inner lamp capsule may be operated at a higher temperature with a reduced occurrence of devitrification as to the higher temperature. Pure oxygen enhances fires, so for safety, an inert carrier gas, such as xenon may be mixed with the oxygen.

The fill gas preferably has a less than atmospheric pressure at normal temperature. Thermal conduction between the inner lamp capsule and outer envelope is increased with greater fill gas pressure. Reducing the fill gas pressure helps thermally insulate the inner lamp capsule, and preserve the heat energy of the inner lamp capsule. On the other hand, the surface preservation, coating protection, and gettering aspects of a fill gas, such as oxygen are reduced with lower pressure. A balancing of priorities is then made. Applicants suggest a fill gas pressure of 160 torr at normal temperature.

Having an oxygen rich atmosphere around the coatings stabilize and extends the coatings operating temperature range. In a similar fashion, an oxygen or oxygen and inert fill gas in the intermediate volume may be used to preserve and protect surface coatings such as metal oxides and other oxides, made along the surfaces adjacent the intermediate volume. Oxygen in the intermediate fill gas also protects doped quartz, such as titanium and vanadium doped quartz. An oxygen rich atmosphere in the intermediate volume is particularly useful in arc discharge lamps. Oxygen is a good insulating or arc depressing gas. Even at a low pressure of 150 torr, oxygen is able to quench corona glow. Since the corona is quenched, power is not lost in starting, operating or restarting the lamp.

Hydrogen is known to be attracted or active with oxygen. In an oxygen atmosphere or oxygen containing fill gas, particularly at warm atmosphere, hydrogen reacts readily with the oxygen to form water. Once the hydrogen is tied up as a water molecule it is unlikely to be freed, and is too large to permeate the inner envelope. The hydrogen can therefore escape from the inner lamp capsule, but cannot migrate from the outside into the inner lamp capsule. Hydrogen gettering by oxygen reduces the amount of hydrogen in the inner lamp capsule thereby improving lamp life and function.

In a working example a doubled jacketed arc discharge lamp was made. The structure and dimensions were approximately as follows: The arc discharge was designed to be formed between two generally side by side electrodes. The electrodes were positioned in a 7.0 mm diameter quartz tube and press sealed at one end to entrain the inner electrode leads, sealing conductive foils and outer connection leads in a 1.35 cm long press seal. A 7.0 mm section of tube extended beyond the press seal encompassing the outer leads as a skirt. The opposite end of the inner envelope tube was tipped off creating an inner lamp capsule section approximately 1.0 cm long, and 0.7 cm in diameter. The electrode containing arc discharge capsule was then positioned coaxially in a 1.5 cm diameter ozone free quartz outer tube, so the skirt was overlapped by the end of the outer glass tube. The lamp capsule, and outer envelope tube were then synchronously rotated in a flame playing on the outer envelope tube. The outer envelope tube was then necked down to close on the skirt portion of the press seal. The skirt and necked down portion of the outer envelope tube fused forming a hermetic seal. The necked down portion of the outer envelope was about 1.5 cm diameter. The outer envelope extended about 1.5 cm at 1.5 cm diameter over the inner envelope. The outer envelope then enclosed an intermediate volume of about 3.0 mm depth around the inner lamp capsule. The intermediate volume was filled with nitrogen and tipped off. The skirt portion of the inner capsule then acted as a sort of cork for the necked down portion of the outer envelope. The ozone free quartz blocked ultraviolet light below 200 nanometers, but allowed the 253.7 nanometer mercury line to pass thereby forming a germicidal spectrum that did not generate ozone. The combined inner envelope and outer envelope were positioned in a bayonet type mount. One lamp lead was welded to the bayonet housing while a second lead was mounted centrally in a ceramic contact holder. The bayonet mount and the cavity formed by the skirt surrounding the lamp leads were then filled with a high dielectric cement to hold the fused inner and outer envelopes and leads in place while insulating the leads. The portion of the inner lamp capsule not shielded by the outer envelope was still shielded by the cement, and bayonet mount. Nonetheless, since the cement, and bayonet mount were not particularly thermally conductive, the inner envelope remained substantially thermally insulated.

The lamp was rated as 100 watt, 65 volt, with a color temperature of 4200° K., a color rendering index of 80+ and a lumen output of 7500+. The disclosed dimensions, configurations and embodiments are as examples only, and other suitable configurations and relations may be used to implement the invention. FIG. 9 shows an axial cross section of the example lamp made.

In an alternative example, the intermediate volume was filled with pure oxygen at a pressure of 160 torr then closed. The lamp was operated with no detrimental affects notice due to the oxygen in the intermediate volume.

While there have been shown and described what are at present considered to be the preferred embodiments of the invention,. it will be apparent to those skilled in the art that various changes and modifications can be made herein without departing from the scope of the invention defined by the appended claims.

What is claimed is:

1. A double jacket arc lamp comprising:

(a) an electric lamp capsule having an inner light transmissive envelope with electrical leads extending from the inner envelope through a first press seal having an inner side adjacent the enclosed volume, a central portion where the seal is made, and an outer side adjacent the exterior, and (b) a tubular, second light transmissive envelope sealed to the inner envelope at a second seal to substantially surround the electric lamp capsule and form an enclosed volume between a portion of the exterior of the inner envelope and the interior of the outer envelope with the leads extending to the exterior of the outer envelope.

2. The apparatus in claim 1, wherein the second seal, sealing the outer envelope, is made to the electric lamp capsule adjacent the inner side of the press seal.

3. The apparatus in claim 1, wherein the second seal, sealing the outer envelope, is made to the electric lamp capsule adjacent the central portion of the press seal.

4. The apparatus in claim 1, wherein the second seal, sealing the outer envelope, is made to the electric lamp capsule adjacent the outer side of the press seal.

5. The apparatus in claim 1, wherein the electric lamp capsule includes a skirt extending from the press seal adjacent the outer side of the press seal having a first outer diameter, and the outer envelope has a portion with an inner diameter equal to the outer diameter sealed to the skirt.

6. The apparatus in claim 1, wherein the inner envelope and outer envelope have matched coefficients of thermal expansion in the region of lamp operation.

7. The apparatus in claim 1, wherein the electric lamp capsule is an arc discharge electric lamp capsule.

8. The apparatus in claim 1, wherein the electric lamp capsule is formed from quartz.

9. The apparatus in claim 1, wherein the electric lamp capsule is formed from a material absorbing a first portion of the spectrum, while transmitting a second portion of the spectrum.

10. The apparatus in claim 1, wherein the outer envelope is formed from a material absorbing a first portion of the spectrum, while transmitting a second portion of the spectrum.

11. The apparatus in claim 10, wherein the outer envelope is formed from an ozone free quartz.

12. The apparatus in claim 1, wherein the outer envelope is formed from a hard glass.

13. The apparatus in claim 12, wherein the hard glass is a borosilicate.

14. The apparatus in claim 1, wherein the seal between the inner electric lamp capsule and the outer envelope is a thermally graded seal.

15. The apparatus in claim 14, wherein the graded seal between the inner electric lamp capsule and the outer envelope includes an intermediate layer of material with a coefficient of thermal expansion intermediate the coefficients of thermal expansion for the electric lamp capsule and the outer envelope.

16. The apparatus in claim 1, wherein the volume enclosed between the inner envelope and outer envelope is a vacuum.

17. The apparatus in claim 1, wherein the volume enclosed between the inner envelope and outer envelope is filled with an inert gas.

18. The apparatus in claim 1, wherein outer envelope is coated with a light absorbing material.

19. The apparatus in claim 1, wherein the inner envelope has the general form of a tube, closed at one end and press sealed at a point offset from the opposite end to leave a portion of the tube substantially intact on the outside of the press seal thereby forming a skirt portion.

20. The apparatus in claim 19, wherein the outer envelope is necked down to seal with the skirt portion.

21. The apparatus in claim wherein the skirt portion is flared out to seal with the outer envelope.

22. The apparatus in claim 1, wherein a separate skirt portion is sealed to the press seal of the lamp capsule with the leads extending through the skirt portion to the exterior, and the skirt portion is sealed to the second envelope to complete a seal between the lamp capsule and the second envelope.

23. A double jacket arc lamp comprising:

(a) an arc discharge electric lamp capsule having an inner light transmissive envelope with first and second electrical leads extending from opposite ends of the inner envelope through a first press seal, and a second press seal, and (b) a tubular, second light transmissive envelope sealed to the inner envelope at a third seal and a fourth seal to substantially surround the electric lamp capsule and form an enclosed volume between a portion of the exterior of the inner envelope and the interior of the outer envelope with the leads extending to the exterior of the outer envelope.

24. The apparatus in claim 23, wherein the outer envelope is necked down at least the third seal to seal with a skirt portion extending from the first seal.

25. The apparatus in claim 23, wherein a skirt portion extending from the first seal portion is flared out to seal with the third seal portion of the outer envelope.

26. A double jacket arc lamp comprising:

(a) an electric lamp capsule having a first exterior light transmissive envelope with electrical leads extending from the inner envelope through a first seal, wherein the inner envelope has the general form of a tube, closed at one end and press sealed at a point offset from the opposite end to leave a portion of the tube substantially intact on the outside of the press seal thereby forming a skirt portion, and (b) a second light transmissive envelope sealed to the inner envelope at a second seal to substantially surround the electric lamp capsule and form an enclosed intermediate volume between the exterior of the inner envelope and the interior of the outer envelope, with the leads extending to the exterior wherein the outer envelope has the general form of a tube, closed at one end and necked to a narrower diameter at an opposite end, and the electric lamp capsule having an outer diameter adjacent and approximately equal to the inner diameter of the necked portion to close with and seal against the necked portion of the second envelope.

* * * * *